US007628483B2

(12) United States Patent
Nakagawa

(10) Patent No.: US 7,628,483 B2
(45) Date of Patent: Dec. 8, 2009

(54) IMAGE FORMING APPARATUS

(75) Inventor: Tomohito Nakagawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 489 days.

(21) Appl. No.: 11/688,326

(22) Filed: Mar. 20, 2007

(65) Prior Publication Data

US 2007/0222845 A1 Sep. 27, 2007

(30) Foreign Application Priority Data

Mar. 24, 2006 (JP) ..... 2006-083767

(51) Int. Cl.
*B41J 29/13* (2006.01)

(52) U.S. Cl. ..... 347/108; 400/663

(58) Field of Classification Search ..... 347/108, 347/104–105; 400/158, 158.1, 589, 663, 400/670.2; 399/379, 380
See application file for complete search history.

(56) References Cited

U.S. PATENT DOCUMENTS 5,802,426 A 9/1998 Miyazaki et al. ..... 399/113
6,626,594 B1 * 9/2003 Lallemant ..... 400/589
6,851,802 B2 * 2/2005 Sakakibara et al. ..... 347/108
6,916,052 B2 * 7/2005 Yamada et al. ..... 292/44

FOREIGN PATENT DOCUMENTS

| | | |
|---|---|---|
| JP | 3-61959 | 3/1991 |
| JP | 7-295459 | 11/1995 |
| JP | 9-325543 | 12/1997 |
| JP | 10-187002 | 7/1998 |
| JP | 2003-223090 | 8/2003 |
| JP | 2003-255803 | 9/2003 |
| JP | 2004-240376 | 8/2004 |

* cited by examiner

*Primary Examiner*—Lamson D Nguyen
(74) *Attorney, Agent, or Firm*—Fitzpatrick, Cella, Harper & Scinto

(57) ABSTRACT

An image forming apparatus for forming an image on a sheet is provided. The image forming apparatus includes an apparatus main body, a unit which can be inserted into the apparatus main body, a locking device which locks the unit to the apparatus main body when the unit is in a predetermined inserted state in the apparatus main body, and a protrusion member which protrudes from an outer surface of the unit or from an outer surface of the apparatus main body in a state in which the unit is inserted into the apparatus main body but not locked to the apparatus main body by the locking device.

7 Claims, 14 Drawing Sheets

IMAGE FORMING APPARATUS

BACKGROUND OF THE INVENTION

1. Field of the Invention

The present invention relates to an image forming apparatus forming an image on a sheet.

2. Description of Related Art

As an image forming method used for an image forming apparatus, there are a direct transfer system (for example, see Japanese Patent Application Laid-Open No. 7-295459) and an intermediate transfer system (see Japanese Patent Application Laid-Open No. 2004-240376).

In general, service men periodically perform replacement of consumables or maintenance of image forming apparatus at user's site. Recently, a design for the replacement or maintenance performed by users has been required. Therefore, processes of the image formation are designed to be implemented as individual units so that the units in the image forming apparatus can be detachably attachable by the users.

In addition, a jam clearance operation for the transfer material S (jammed paper) needs to be implemented. Japanese Patent Application Laid-Open Nos. 7-295459 and 2004-240376 discuss a construction where a position of a shaft pin in a fixing unit is determined with respect to an apparatus main body and an upper opening cover is opened or closed. In the construction, before the jam clearance operation is performed, the opening cover is rotated by manipulating a lever so as to open a conveyance path. After that, the jam clearance operation is performed.

In addition, Japanese Patent Application Laid-Open No. 10-187002 discusses a conveyance belt unit which is detachably attachable to the apparatus main body. More specifically, Japanese Patent Application Laid-Open No. 10-187002 discusses a construction where, when a conveyance belt unit is mounted on an apparatus main body, a key-shaped portion formed in the locking lever is engaged with a fastening shaft formed on the apparatus main body so that the conveyance belt unit can be held in the apparatus main body.

In such conventional constructions, if the opening cover or the conveyance belt unit is incompletely locked to the apparatus main body, the unit is not mounted on an accurate position, so that malfunction may occur in the image forming apparatus.

SUMMARY OF THE INVENTION

An object of the present invention is to provide an image forming apparatus capable of completely inserting a unit into an apparatus main body by using a simple construction for allowing a user to easily recognize that the unit is not locked to the apparatus main body.

According to an aspect of the present invention, there is provided an image forming apparatus which forms an image on a sheet, comprising: an apparatus main body; a unit which can be inserted into the apparatus main body; a locking device which locks the unit to the apparatus main body when the unit is in a predetermined inserted state in the apparatus main body; and a protrusion member which protrudes from an outer surface of the unit or from an outer surface of the apparatus main body in a state in which the unit is inserted into the apparatus main body but not locked to the apparatus main body by the locking device.

According to the present invention, a user can easily determine whether or not the unit is locked by recognizing a state of the protrusion member.

DESCRIPTION OF PREFERRED EMBODIMENTS

Hereinafter, exemplary embodiments of the present invention are described in detail with reference to the accompanying drawings. The scope of the invention is not limited to dimensions, material, shapes, and arrangement of components disclosed in the embodiments without particularly specified disclosure.

(Image Forming Apparatus)

Figure 1:
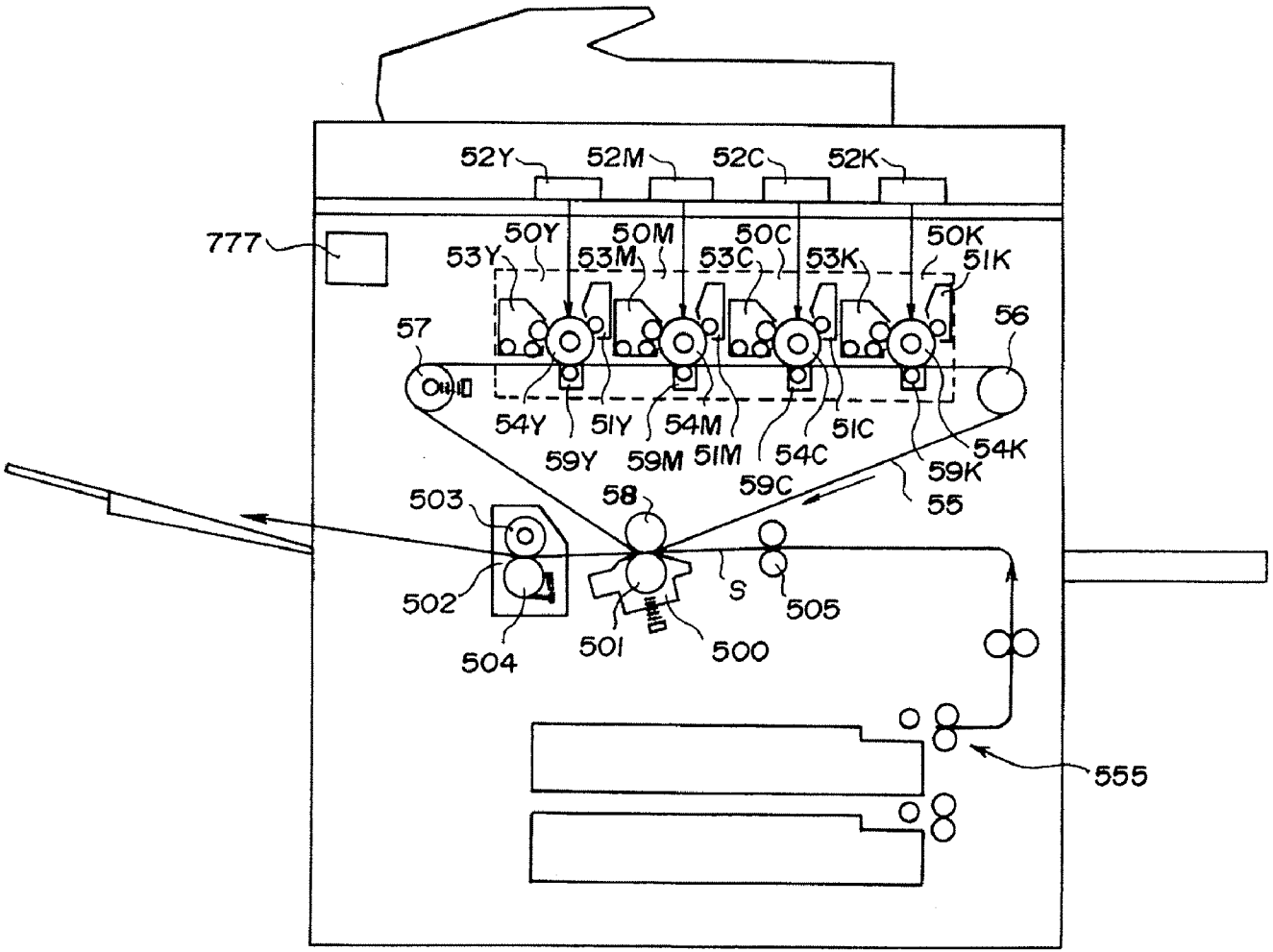
FIG. 1 is a cross sectional view for explaining an image forming apparatus.

Firstly, a whole construction of an image forming apparatus according to an embodiment of the present invention is described in brief with reference to the drawings. The image forming apparatus according to the embodiment is an intermediate transfer tandem-type color image forming apparatus. FIG. 1 is a cross-sectional view for explaining the image forming apparatus.

As shown in FIG. 1, in the image forming apparatus includes, a plurality of image forming portions 50Y, 50M, 50C, and 50K are aligned to form respective color toner images in parallel. Here, Y, M, C, and K denote yellow, magenta, cyan, and black, respectively.

Each of the image forming portions 50Y, 50M, 50C, and 50K includes a corresponding charging device 51Y, 51M, 51C, or 51 K, a corresponding exposing device 52Y, 52M, 52C, or 52 K, a developing device 53Y, 53M, 53C, or 53K, and a photosensitive drum 54Y, 54M, 54C, or 54K. An intermediate transfer belt 55 is suspended in a tensioned state by a driving roller 56, a tension roller 57, and a secondary transfer inner roller 58 to rotate in the direction indicated by arrow in the figure. The color toner images are sequentially primarily-transferred on the intermediate transfer belt 55 in an overlapped manner by corresponding primary transfer devices 59Y, 59M, 59C, and 59K. Although color sequence in FIG. 1 is Y-M-C-K, the present invention is not limited thereto.

The color toner image formed on the intermediate transfer belt 55 is secondarily-transferred on a transfer material (transfer paper) S conveyed from a feeding portion 555 by a secondary transfer device 500 at one time. The secondary transfer device 500 includes a secondary transfer outer roller 501. The secondary transfer outer roller 501 is pressed to face the secondary transfer inner roller 58 so as to form a transfer nip. As a result, the toner image is adsorbed electro-statistically on the transfer material S.

After the secondary transfer, the transfer material S is received by a fixing device 502. A fixing nip is formed on the fixing device 502 by a fixing roller 503 and a pressing roller 504, and the toner image on the transfer material S is conveyed while being heated and pressed. As a result, a fused toner image is heated and fixed on the transfer material S, so that a full color image fixed on the transfer material S can be obtained.

(State of Conveyance Unit in Main Body)

Next, a construction where the conveyance unit 2 as a sub-housing is drawn out from or inserted into the apparatus main body 1 as a main housing in the direction of arrow A is described with reference to FIGS. 2 to 6B. In the image forming apparatus according to the embodiment, the conveyance unit 2 is arranged to be drawn out from or inserted into a side of the apparatus main body 1 in the horizontal direction. The conveyance unit 2, as an individual unit, is drawn out from the apparatus main body 1 so as to open an opening 666 of the apparatus main body 1. The conveyance unit 2 can be moved between a position (see FIG. 4) where the conveyance unit 2 is drawn out from the apparatus main body 1 and a position (see FIGS. 2 and 3) where the conveyance unit is inserted into the apparatus main body 1 so as to close the opening 666. The conveyance unit 2 is locked by a later-descried locking device 6 to be coupled with the apparatus main body 1.

Figure 2:
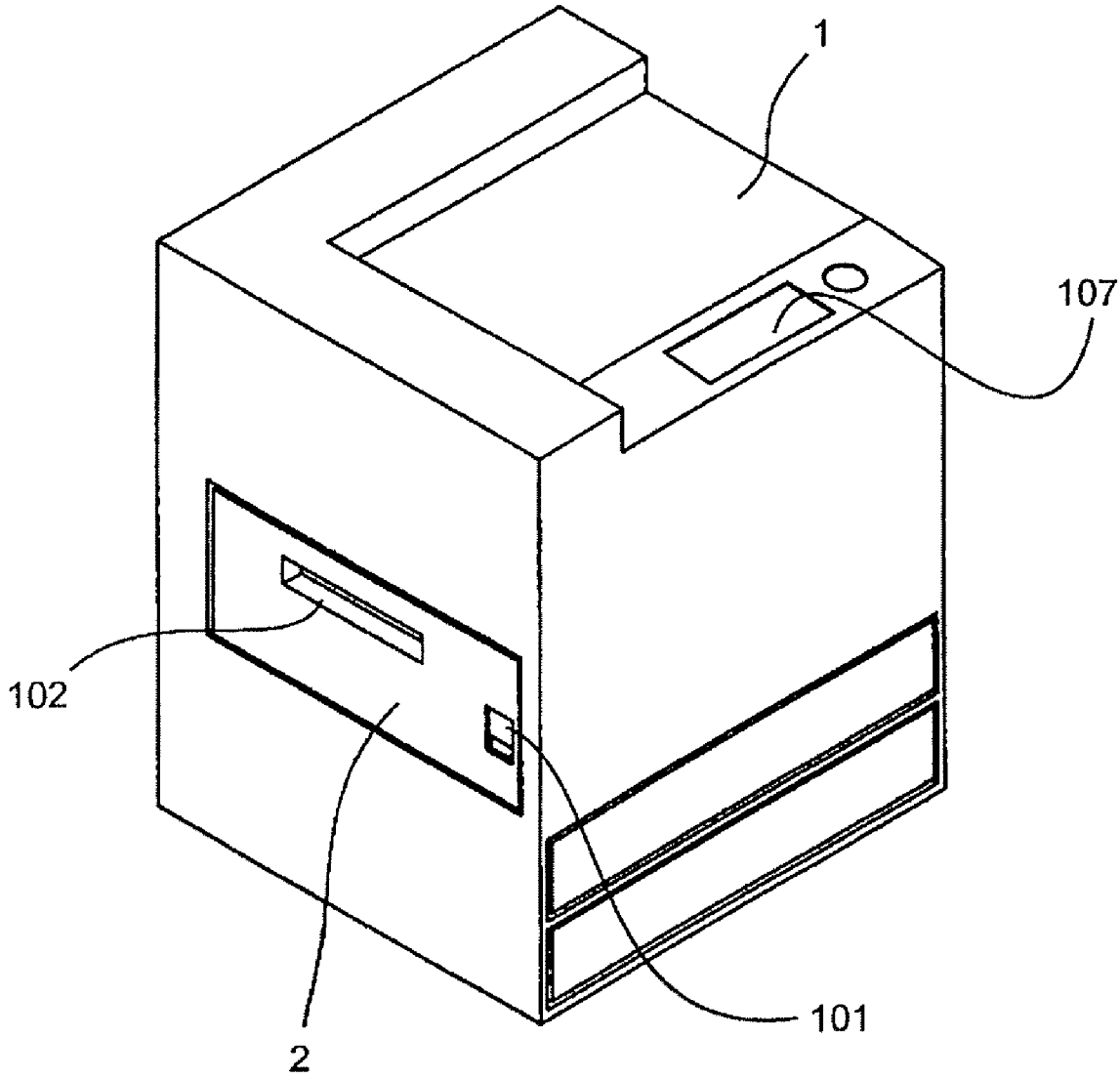
FIG. 2 is a perspective view illustrating a state of main body 1 into which a conveyance unit 2 is inserted.
Figure 3:
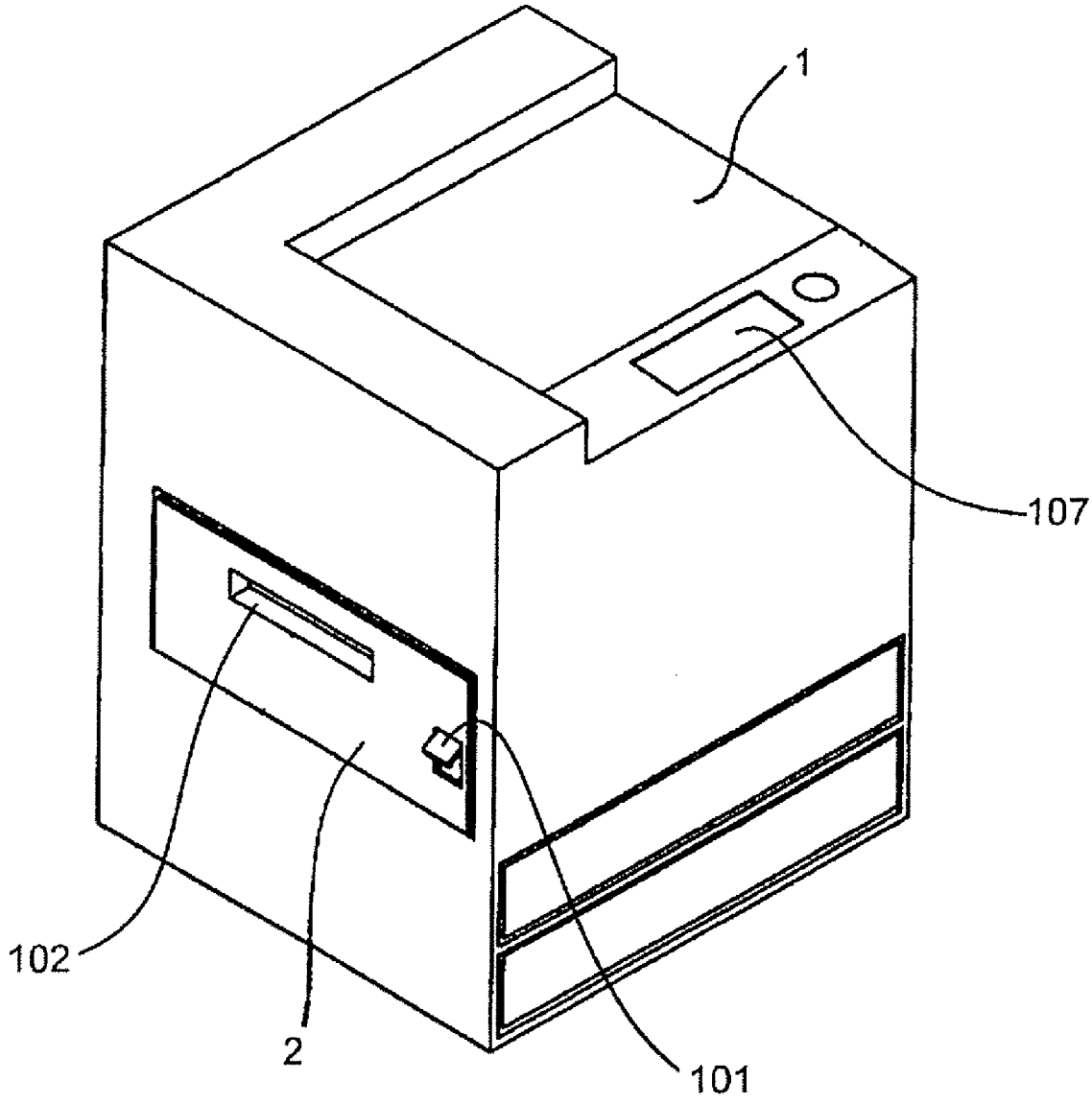
FIG. 3 is a perspective view illustrating a state of the apparatus main body 1 in which the conveyance unit 2 is half-opened.
Figure 4:
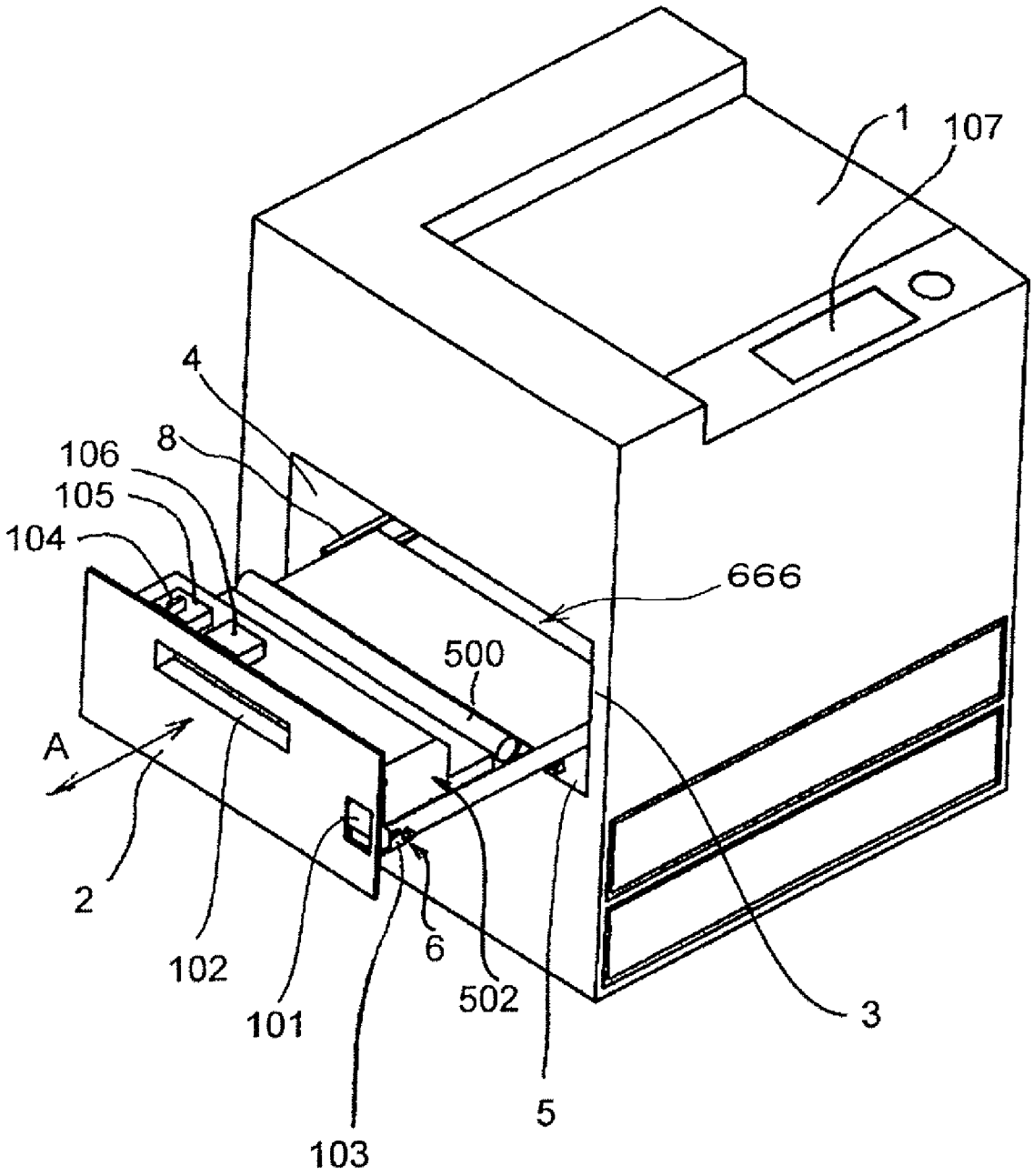
FIG. 4 is a perspective view illustrating a state of the apparatus main body 1 in which the conveyance unit 2 is ejected from the apparatus main body 1.

Now, three states of the conveyance unit 2 inserted into the apparatus main body 1 are described. FIG. 2 is a perspective view illustrating a state where the conveyance unit 2 is inserted into the apparatus main body 1 and the conveyance unit 2 is locked to the apparatus main body 1 by the later-described locking device 6. FIG. 3 is a perspective view illustrating a state where the conveyance unit 2 is inserted into the apparatus main body 1 but not locked by the locking device 6 (that is, a half-opened state). FIG. 4 is a perspective view illustrating a state where the conveyance unit 2 is drawn out from the apparatus main body 1.

As shown in FIGS. 2 to 4, a grip 102 for manipulation of inserting and drawing out the conveyance unit 2 is additionally provided to a side of the conveyance unit 2. In addition, a lever 101 is provided on the same surface as the surface where the grip 102 is formed. A user manipulates the lever 101 so as to release the coupling of the conveyance unit 2 with the apparatus main body 1.

As shown in FIG. 2, in a normal state and an image forming operating state, the conveyance unit 2 is completely inserted into the apparatus main body 1, and the conveyance unit 2 is in a positioned, fixed state. In this state, the lever 101 is pushed down to the conveyance unit 2 so as not to project from the side of the conveyance unit 2.

As shown in FIG. 3, in the half-opened state of the conveyance unit 2, the lever 101 as a protrusion member is erected from the conveyance unit 2 so as to protrude from the side of the apparatus main body 1.

Here, the half-opened state denotes not a state that the conveyance unit 2 is completely inserted into the apparatus main body 1 but a state just before a hook 103 of the later-described locking device 6 is engaged with a pin (engagement protrusion member) 111. In the half-opened state, the conveyance unit 2 is shown to slightly protrude from the side of the apparatus main body 1, but the user cannot easily determine based on the position of the conveyance unit 2 whether or not the conveyance unit 2 is completely inserted. More specifically, in the half-opened state, later-described connectors 114 and 116 of the conveyance unit 2 are not completely inserted into relay drawer connectors 105 and 106 described below. That is, the half-opened state is a temporary state. In the half-opened state, the position of the conveyance portion for the transfer material S is not secured, so that jam may occur. Therefore, the half-opened state needs to be effectively avoided.

As shown in FIG. 4, when the conveyance unit 2 is drawn out from the apparatus main body 1 in the paper conveying direction (direction A), movement of the conveyance unit 2 is stopped by a stopper (not shown). Therefore, the opening 666 of the apparatus main body 1 is maintained in the opened state. In this state, the user can remove the jammed sheet from the inner portion of the apparatus main body 1 through the opening 666.

(Construction of Main Body 1)

Figure 5:
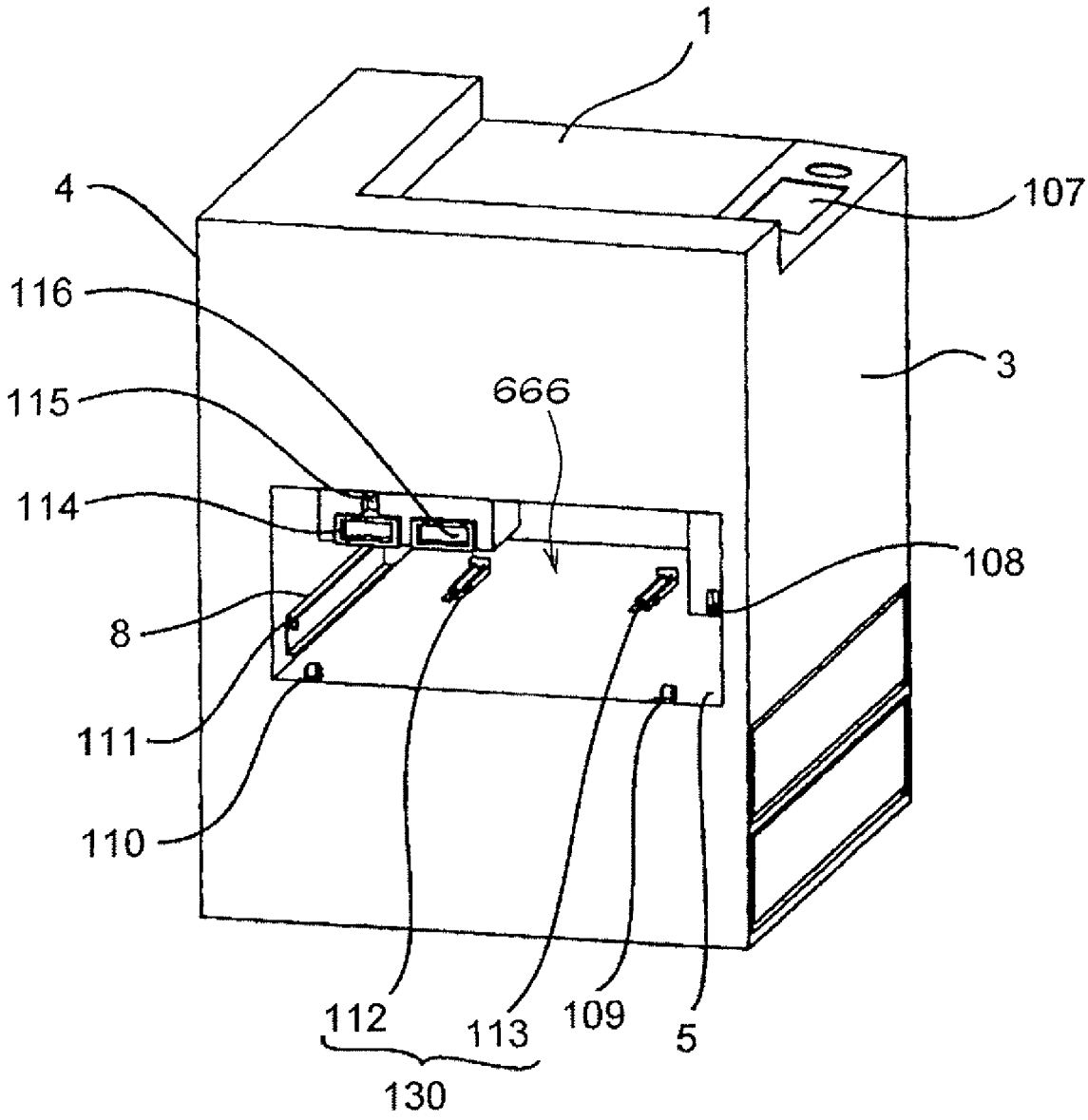
FIG. 5 is a perspective view for explaining an inner portion of the apparatus main body 1.
Figure 6A:
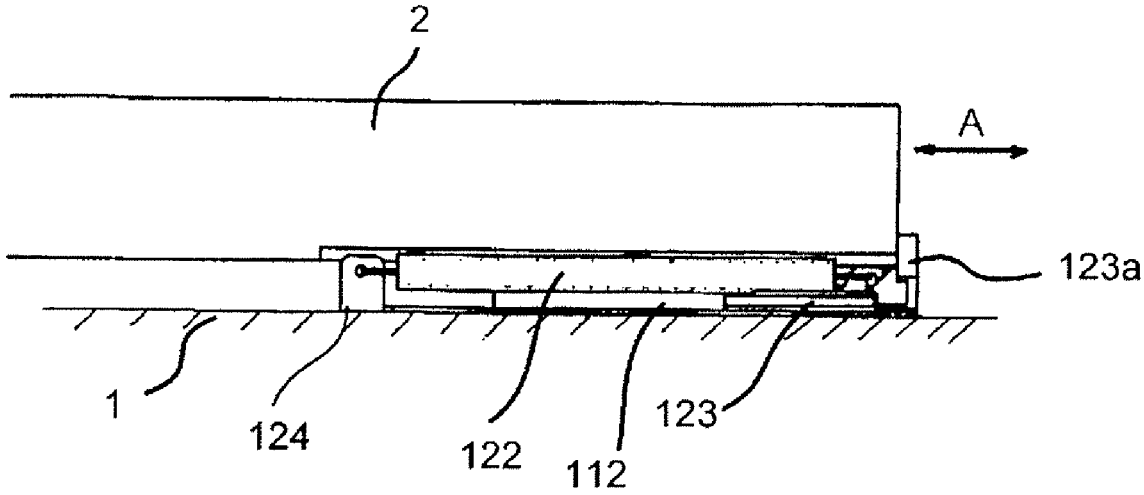
FIGS. 6A and 6B are side views for explaining a slide mechanism 130 of the apparatus main body 1.
Figure 6B:
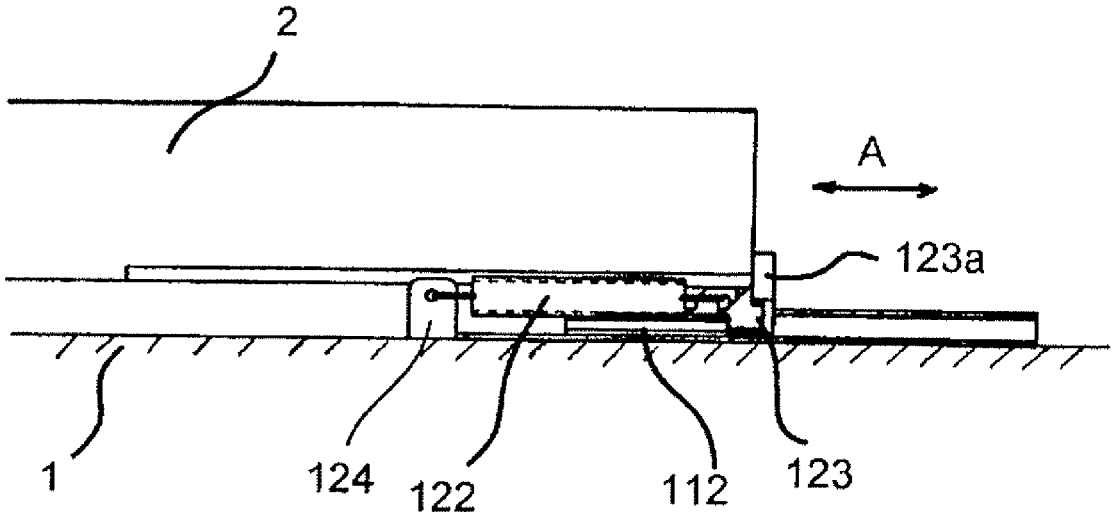
Figure 7:
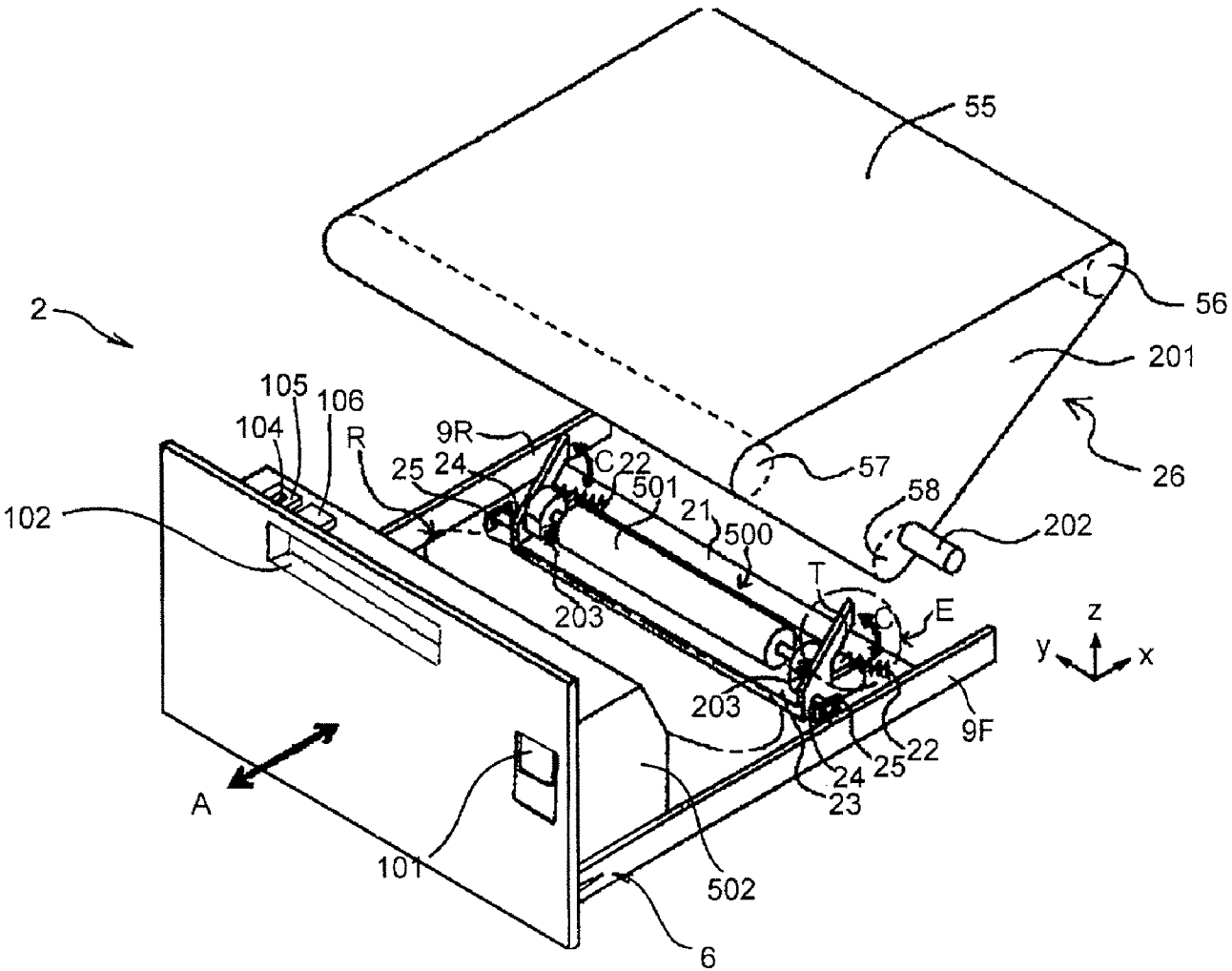
FIG. 7 is a perspective view for explaining an intermediate transfer belt unit 26 and a conveyance unit 2.

Detailed construction of the apparatus main body 1 is described with reference to FIGS. 4 and 5. FIG. 5 is a perspective view illustrating an internal construction of the apparatus main body 1 where the conveyance unit 2 is eliminated. FIGS. 6A and 6B are side views for explaining a slide mechanism 130 of the apparatus main body 1. FIG. 7 is a perspective view for explaining an intermediate transfer belt unit 26 and the conveyance unit 2.

As shown in FIGS. 4 and 5, the apparatus main body 1 according to the embodiment includes main-body side plates 3 and 4, a lower plate 5, and a stay member. As shown in FIG. 1, various individual devices required for an image forming process such as photosensitive drums 54, charging devices 51, exposing devices 52, developing devices 53, and an intermediate transfer belt 55 are contained in the apparatus main body 1 as units.

As shown in FIG. 5, bearings 109 and 110 are respectively disposed at front side and rear side in the opening 666 of the main body side plate of the apparatus main body 1. In a side of an inner space which is continuous with the opening 666 of the apparatus main body, a rail member 8 is provided to extend in a direction (a sub-scanning direction indicated by arrow A in FIG. 4) parallel to a conveying direction of the transfer material. Accordingly, a side surface of a later-described rail frame 9 of the conveyance unit 2 is guided by the rail member 8, and a bottom thereof is arranged to contact with the bearings 109 and 110. Since the bearings 109 and 110 are disposed under the bottom of the rail frame 9, the conveyance unit 2 can be smoothly moved by a weak manipulating force.

In a rear side of the inner space which is continuous with the opening 666 of the apparatus main body, a slide mechanism 130 is provided to press the conveyance unit 2 toward the opening. The slide mechanism 130 provided to the apparatus main body 1 includes pushing-out sliders 112 and 113.

The slide mechanism 130 is described in detail with reference to FIGS. 6A and 6B. FIGS. 6A and 6B illustrate the slide mechanism of the conveyance unit 2. More specifically, FIG. 6A is a side view of the slide mechanism in the state where the conveyance unit 2 is completely positioned, and FIG. 6B is a side view of the slide mechanism in the state where the conveyance unit 2 is ejected. Since two pushing-out sliders 112 and 113 have the same construction, only the pushing-out slider 112 is described.

As shown in FIGS. 6A and 6B, the pushing-out slider 112 provided to the apparatus main body 1 is provided with an L-shaped slider 123 which can be slidably moved together with the conveyance unit 2 in the direction A. A spring 122 is suspended between a supporting member 124 at a front side of the conveyance unit 2 in the inserting direction thereof and an L-shaped erected surface 123*a* of the slider 123. Therefore, due to a biasing force of the spring 122 to the erected surface 123, the conveyance unit 2 is always biased by the spring 123 in the direction (rightward direction in the figure) where the conveyance unit 2 is separated from the apparatus main body 1.

As shown in FIG. 6A, in the state where the conveyance unit 2 is locked to the apparatus main body 1, when the hook 103 is disengaged from the pin 111 by the later-described method, the erected surface 123*a* is biased in the drawing-out direction (leftward direction) of the conveyance unit 2 by the spring 122. As a result, as shown in FIG. 6B, the conveyance unit 2 is moved in the leftward direction in the figure. Accordingly, the conveyance unit 2 is automatically ejected from the apparatus main body 1. Therefore, the user can draw out the conveyance unit 2 without a strong force. In addition, the spring 122 generates a repulsive damping force when the conveyance unit 2 is inserted into the apparatus main body 1.

In this manner, due to the pushing-out sliders 112 and 113, when the locking of the conveyance unit 2 is released by erecting the lever 101, the conveyance unit 2 is automatically moved to protrude outwards from the apparatus main body 1 by the biasing force of the spring 122. Accordingly, the conveyance unit 2 can be easily replaced.

Connectors 114 and 116 connected to later-described relay drawer connectors 105 and 106 in the apparatus main body 1 are disposed in the vicinity of the opening 666 of the apparatus main body. A sensing portion 115 for sensing a later-described flag 104 is formed in an upper portion of the connector 114.

As shown in FIG. 7, the intermediate transfer belt unit 26 is accommodated in the apparatus main body 1. In the intermediate transfer belt unit 26, the intermediate transfer belt 55 is suspended in a tensioned state by the tension roller 57, the driving roller 56, and the secondary transfer inner roller 58. The three rollers 56, 57, and 58 are rotatably supported by an intermediate transfer frame 201. The intermediate transfer frame 201 has a positioning boss 202 for the secondary transfer device 500. In addition, at a position opposite to the viewing position of FIG. 7, a frame (not shown) and a positioning boss 202 along the same shaft are provided.

(Construction of Conveyance Unit 2)

Detailed construction of the conveyance unit 2 is described with reference to FIGS. 4 and 7.

As shown in FIGS. 4 and 7, the conveyance unit 2 according to the embodiment includes, as individual units, the secondary transfer device 500 and the fixing device 502.

Relay drawer connectors 105 and 106 are provided in a front upper portion (front portion in the drawing-out direction) of the conveyance unit 2. The relay drawer connectors 105 and 106 transmits power and signals to a heater as a heating source contained in the fixing device 502, a driving motor for conveying the transfer material, sensors, or other electric parts. In addition, a flag 104 for sensing opening and closing positions of the conveyance unit 2 is provided to the conveyance unit 2.

In such a construction, when the conveyance unit 2 is opened or closed, the relay drawer connector 105 of the conveyance unit 2 is connected to or disconnected from a connector 114 of the apparatus main body 1 (see FIG. 5). Similarly, the relay drawer connector 106 of the conveyance unit 2 is connected to or disconnected from a connector 116 of the apparatus main body 1 (see FIG. 5).

When the relay drawer connector 105 is inserted into the connector 114, the flag 104 becomes close to the sensing portion 115 (see FIG. 5). At this time, the flag 104 blocks sensing light of a photosensor of the sensing portion 115. Based on the blocking of the sensing light of the photosensor by the flag 104, it can be sensed that the conveyance unit 2 is inserted into the apparatus main body 1 by the position where the opening 666 of the apparatus main body 1 is closed. Namely, the sensing portion 115 can sense the position of the conveyance unit 2 with respect to the apparatus main body 1 to sense whether the conveyance unit 2 is far from or close to the apparatus main body 1.

In this manner, in the embodiment, the sensing portion 115 for sensing the position of the conveyance unit 2 is disposed to the apparatus main body 1 in the vicinity of the connector 14, and the flag 104 is disposed to the conveyance unit 2 in the vicinity of the relay drawer connector 105.

As shown in FIG. 7, the conveyance unit 2 includes, as engaging portions for the rail member 8 of the apparatus main body 1, two rail frames 9F and 9R. In addition, the conveyance unit 2 includes a reinforcing frame 21 for reinforcing a portion between the rail frames 9F and 9R.

The fixing device 502 is fixed to the conveyance unit 2 so as to be contained in the conveyance unit 2. The fixing device 502 may be fixed to the conveyance unit 2 by using fastening members such as screws. Therefore, the fixing device 502 together with the conveyance unit 2 can be drawn out or inserted in one body, so that workability to replacement or maintenance according to lifecycle of the fixing roller 503 or the pressing roller 504 can be improved.

On the other hand, the secondary transfer device 500 is maintained on the reinforcing frame 21 in an unfixed state through the biasing unit 22. More specifically, a boss 24 provided to a roller holder 23 for holding the secondary transfer outer roller 501 is engaged with a long-hole bearing portion 25 provided to the reinforcing frame 21. Next, the roller holder 23 is pressed on the reinforcing frame 21 by the biasing unit 22. Therefore, the reinforcing frame 21 of the secondary transfer device 500 can be in a movable state in the sub scanning direction by engagement of the boss 24 with the long-hole bearing portion 25.

As shown in FIG. 7, each end portion of the roller holder 23 has a channel-shaped portion E having a tapered surface T. Each of the biasing units 22 is suspended in a slanted direction so as to generate divisional forces in three directions, that is, x, y, and z directions. The x direction is a sub-scanning direction parallel to the conveying direction of the transfer material. The y direction is a main-scanning direction perpendicular to the conveying direction of the transfer material. The z direction is a height direction of the image forming apparatus. Among the biasing forces of the biasing unit 22, at least x-direction divisional force is exerted in the direction for applying a force to the secondary transfer device 500 toward the opposite side of the fixing device 502, and the z-direction divisional force is exerted in the direction for pressing the secondary transfer device 500 toward the surface of the reinforcing frame 21.

(Overview of Operations of Drawing-Out/Inserting Conveyance Unit 2 from/into Main Body 1)

Now, operations of drawing out and inserting the conveyance unit 2 in the direction of arrow A are described in brief with reference to FIG. 7.

When the conveyance unit 2 is inserted into the direction of arrow A, the tapered surface T of the channel-shaped portion E in each end portion of the roller holder 23 is engaged with the positioning boss 202. When the conveyance unit 2 is completely inserted into the apparatus main body 1, a bottom of the channel-shaped portion E contacts with the positioning boss 202, so that the engagement operation is completed.

During the engagement operation, the secondary transfer device 500 is gradually lifted up by the tapered surface T. On the other hand, the secondary transfer device 500 is pushed back by the positioning boss 202 along the long-hole bearing portion 25. Therefore, by drawing out the conveyance unit 2 from the apparatus main body 1, the pressing of the secondary transfer device 500 in the direction of arrow C shown in FIG. 7 is released.

When the secondary transfer device 500 is pressed, the pressing force of the secondary transfer outer roller 501 on the secondary transfer inner roller 58 is further increased by the secondary transfer pressing spring 203, so that the secondary transfer force can be optimized. In addition, the secondary transfer device 500 is arranged to completely follow the positioning boss 202 by biasing unit 22. Therefore, at the time that the pressing of the secondary transfer device 500 is completed, the secondary transfer outer roller 501 is automatically aligned to the secondary transfer inner roller 58.

In this manner, in the embodiment, the fixing device 502 can be aligned to the secondary transfer device (the secondary transfer inner roller 58 and the secondary transfer outer roller 501) of which alignment accuracy is ensured. Therefore, the conveyance unit 2 has a mechanism for adjusting an inserting form in the apparatus main body 1

Although, the positioning is affected by tolerance errors of individualized components, alignment accuracy among the secondary transfer inner roller 58, the secondary transfer outer roller 501, and the fixing device 502 can be maintained. Therefore, deterioration in performance of conveying and transfer and deterioration of image quality caused from decrease in alignment accuracy can be prevented.

In addition, according to the embodiment, when the user draws out the conveyance unit 2 from the apparatus main body 1 the pressing of the secondary transfer outer roller 501 can be automatically released. Particularly, in an intermediate transfer type image forming apparatus having a short path engine, although jam occurs between the secondary transfer device 500 and the fixing device 502, the jammed sheet as inserted in the fixing device 502 can be ejected from the image forming apparatus. As a result, the jam clearance operation can be easily performed without spraying of unfixed toners borne on the jammed sheet into the image forming apparatus.

(Detailed Construction of Locking Unit 6)

Figure 8A:
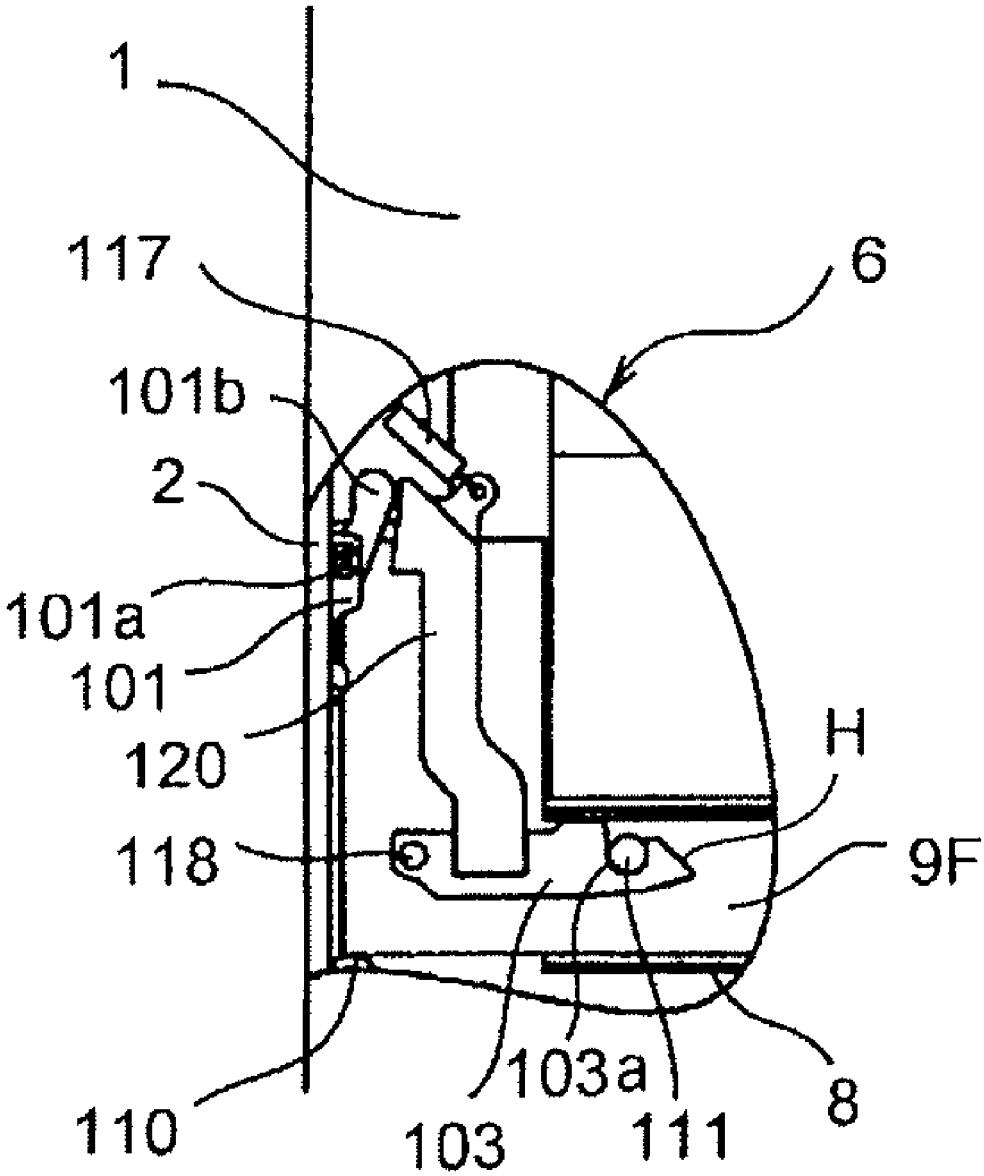
FIG. 8A is a detailed view for explaining a locking portion 6 disposed in an inner portion of the apparatus main body 1.
Figure 8B:
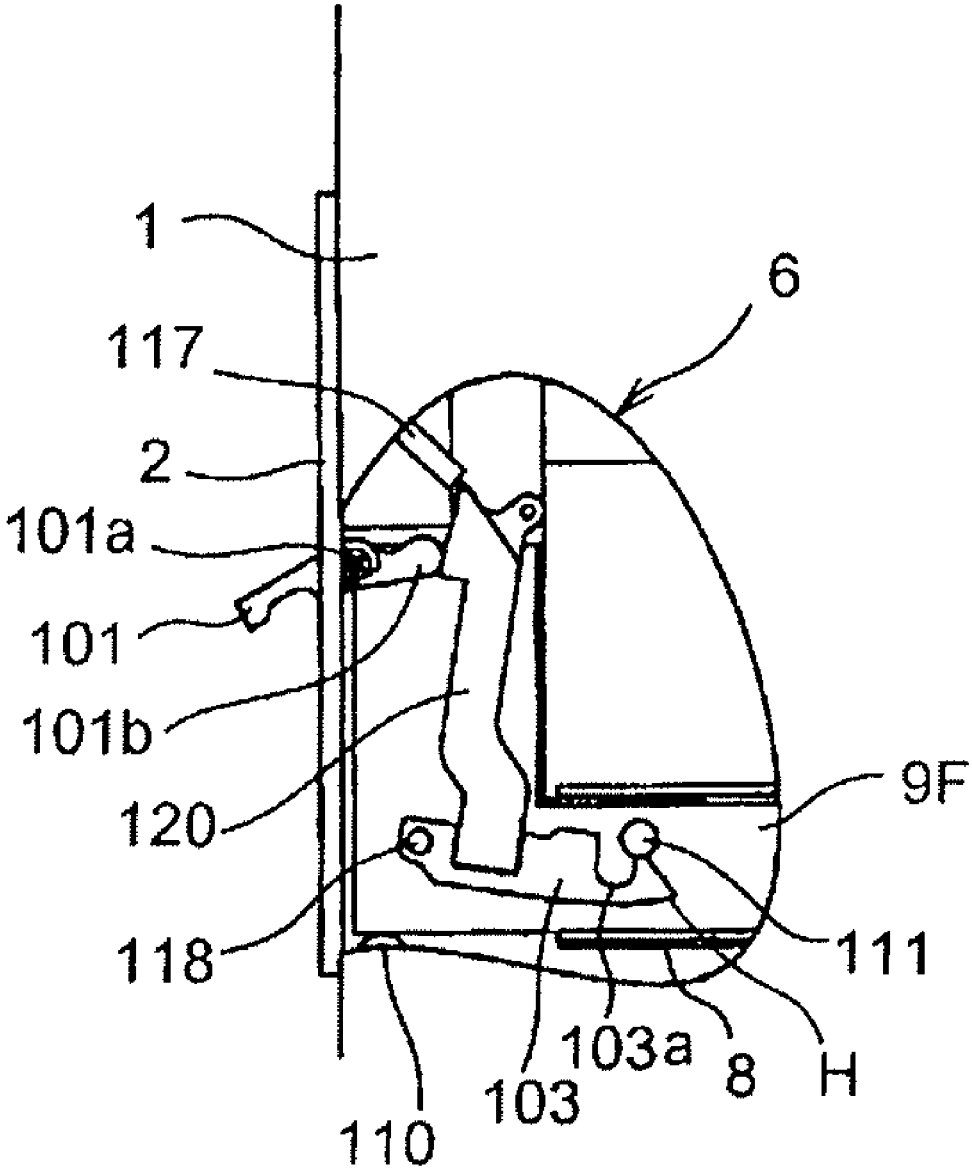
FIG. 8B is a detailed view for explaining the locking portion 6 disposed in an inner portion of the apparatus main body 1.

Detailed construction of the locking portion 6 of the conveyance unit 2 is described with reference to FIGS. 8A and 8B. FIGS. 8A and 8B are detailed views for explaining the locking portion 6 disposed in an inner portion of the apparatus main body 1. More specifically, FIG. 8A is a side view illustrating the locking portion 6 in the state where the conveyance unit 2 is completely positioned. FIG. 8B is a side view of the locking portion 6 in the half-opened state of the conveyance unit 2.

As shown in FIGS. 8A and 8B, the locking device 6 includes a lever 101, an arm 120 of which upper portion contacts an pressing portion 101*b* that is an inner part of the lever 101, a hook 103 having a U-shaped recess 103*a* for being locked to the apparatus main body 1, and a pin 111 which is provided to the apparatus main body 1 to be engaged with the U-shaped recess 103*a* of the hook 103.

The lever 101 has the R-shaped pressing portion 101*b* at a position inner than the rotating shaft 101*a*. If the lever 101 is rotated in the external side, the rotating motion enables the pressing portion 101*b* to pivot about the rotating shaft 101*a*. The lever 101 is applied with a force clockwise by a torsion spring 101*b* (see FIGS. 9A and 9B). As described later, since the upper end of the arm 120 is applied with a force counterclockwise, the pressing portion 101*b* of the lever 101 is also pressed counterclockwise. Therefore, the lever 101 is maintained in the position of FIG. 8A, that is, the position where the lever 101 does not protrude from the outer surface of the conveyance unit 2.

The upper portion of the arm 120 contacts with the pressing portion 101*b*, and the lower portion thereof is integrally fastened to the hook 103. A spring 117 is provided to the upper portion of the arm 120. The spring 117 is a tension spring. Therefore, the arm 120 is rotated about the central rotating shaft 118 to be applied with a force counterclockwise in FIGS. 8A and 8B.

As described above, the hook 103 is integrally fastened to the lower portion of the arm 120. In the conveyance unit 2, two hooks 103 are disposed at both ends of the central rotating shaft 118 which is provided to extend and penetrate in the longitude direction of the conveyance unit 2 at the front side thereof. The hooks provided to both ends of the central rotating shaft 118 have the same shape. The central rotating shaft 118 is inserted into one end of the hook 103, and the U-shaped recess 103*a* is formed in the opposite end thereof from the central rotating shaft 113 of the pushing-out slider 118. The U-shaped recess 103*a* is engaged with the pin 111 provided to the apparatus main body 1.

According to such a construction, when the conveyance unit 2 is locked to the apparatus main body 1, the conveyance unit 2 is slidably moved to be inserted into the apparatus main body 1. When the conveyance unit 2 is in a predetermined inserting position in the apparatus main body 1, the locking device 6 locks the conveyance unit 2. More specifically, while the conveyance unit 2 is slidably moved to be inserted into the apparatus main body 1, the taper portion H at the distal end of the hook 103 contact with the pin 111 provided to the apparatus main body 1. The hook 103 is rotated clockwise against the force of the spring 117. In the state where the hook 103 is rotated clockwise, the lever 101 is in the state of protruding from the outer surface of the conveyance unit 2 (state of FIG. 8B).

When the pin 111 overrides a taper portion H of the hook 103 by further pushing the conveyance unit 2 into the apparatus main body 1, the U-shaped recess 103*a* of the hook 103 is engaged with the pin 111 provided to the apparatus main body 1 as shown in FIG. 8A. Alternatively, the U-shaped recess 103*a* of the hook 103 may be engaged with the pin 111 by the user erecting the lever 101 to insert the conveyance unit 2 into the apparatus main body 1 and, after that, taking a hand off the lever 101. Due to the engagement of the U-shaped recess 103*a* of the hook 103 with the pin 111, the conveyance unit 2 can be locked to the apparatus main body 1 by the locking device 6. As a result of the locking of the conveyance unit 2 to the apparatus main body 1 by the locking device 6, the conveyance unit 2 can be completely positioned in the apparatus main body 1.

The pin 111 is disposed at a high accuracy in each of the main-body side plates provided to the apparatus main body 1. Therefore, the hook 103 is also disposed at a high accuracy at each of the front inner sides of the conveyance unit 2. The hooks in the front inner sides are engaged with the pins 111, so that alignment of a conveyance portion between the apparatus main body 1 and the conveyance unit 2 can be ensured.

The pin 111 may be a rolling pin or other rotating members such as a roller and a bearing. By using such a pin, the hook 103 can be smoothly engaged with the pin 111. In this case, the hook 103 is automatically engaged with the pin 111 by the force of the tension spring 117, so that the half-opened state of the conveyance unit 2 can be effectively prevented.

According to the aforementioned construction, when the locking to the apparatus main body 1 is to be released, the user firstly erects the lever 101 as shown in FIG. 8B. As a result, the pressing portion 101*b* is rotated around the rotating shaft 101*a* clockwise in the figure. Therefore, the pressing portion 101*b* contacts with the arm 120, and the arm 120 and the hook 103 are rotated around the central rotating shaft 118 clockwise. Accordingly, the hook 103 is disengaged from the pin 111, so that the locking is released.

After completely drawing out the conveyance unit 2 from the apparatus main body 1, the user slidably moves the conveyance unit 2 in the apparatus main body so as to insert the conveyance unit 2 into the apparatus main body 1. In this case, the conveyance unit 2 may be in the state where the conveyance unit 2 is inserted into the apparatus main body 1 but the locking device 6 is not locked. Namely, the conveyance unit 2 may be in the half-opened state where the U-shaped recess 103*a* of the hook 103 is not engaged with the pin 111. In the embodiment, as shown in FIG. 8B, when the conveyance unit 2 becomes close to the apparatus main body 1 but in the half-opened state where the hook 103 is not engaged with the pin 111, the lever 101 is erected to protrude from the outer surface of the conveyance unit 2. By confirming the protrusion of the lever 101, the user can recognize easily and accurately the hook 103 provided to the conveyance unit 2 is not completely engaged with the pin 111 provided to the apparatus main body 1.

If the user can recognize the incomplete locking of the conveyance unit 2, the user accurately completes the manipulation by the drawing and inserting of the conveyance unit 2 accurately. In addition, since the lever 101 is designed to be erected, the user can easily grip the lever 101 to draw out the conveyance unit 2. For example, in a case where the half-opened state is caused from a frictional force of connecting and disconnecting the relay drawer connectors 105, the user can easily recover the manipulation.

(Lock Sensing Unit 7 of Locking Portion 6)

Figure 9A:
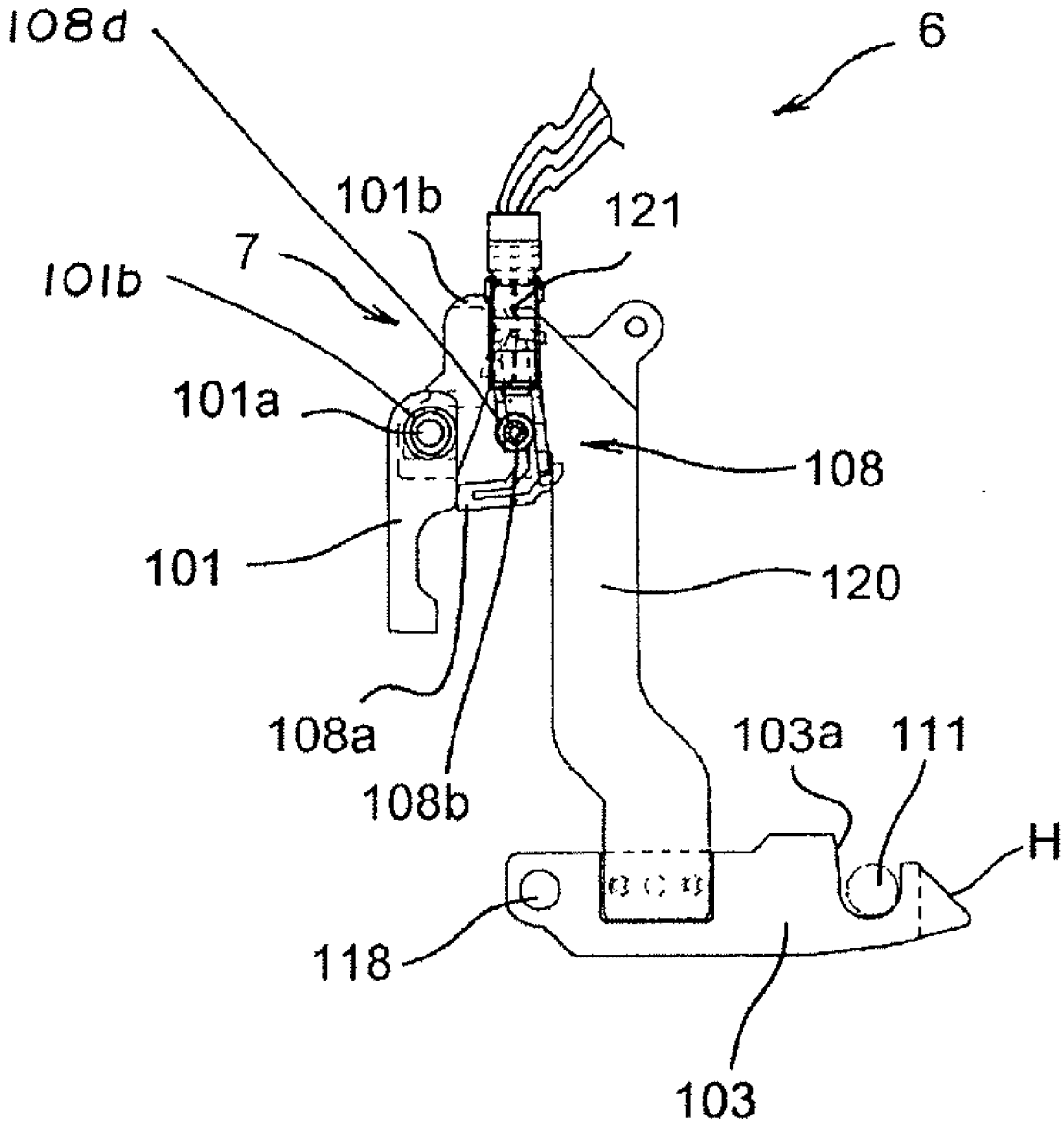
FIG. 9A is a detailed view for explaining a structure of a lock sensing portion 7 of the locking portion 6.
Figure 9B:
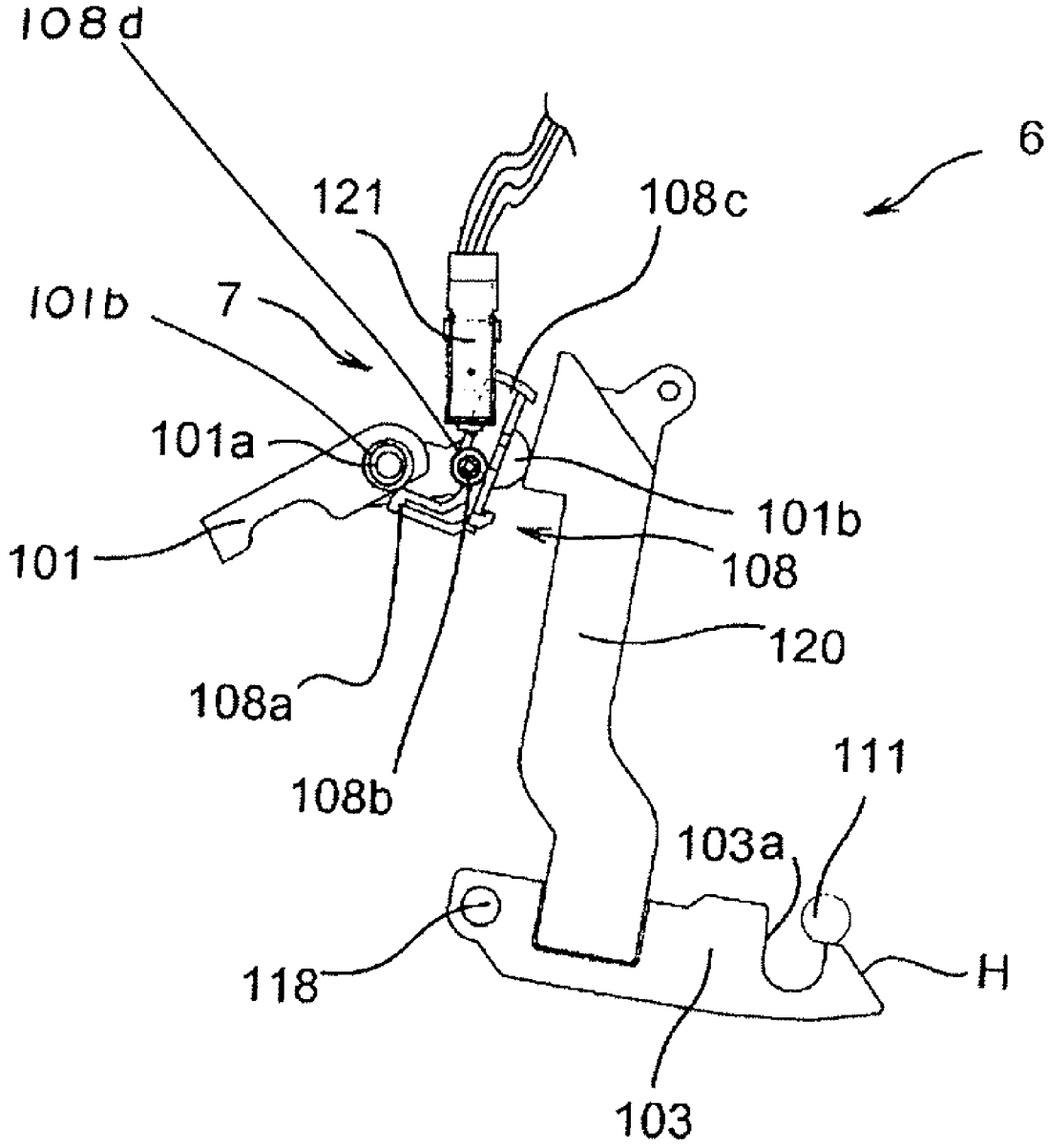
FIG. 9B is a detailed view for explaining a structure of a lock sensing portion 7 of the locking portion 6.

A lock sensing portion 7 of the locking portion 6 is described with reference to FIGS. 9A and 9B. FIGS. 9A and 9B illustrate a construction of the lock sensing portion 7 for sensing the states of locking in the locking portion 6. More specifically, FIG. 9A is a side view of the lock sensing portion 7 of the locking device 6 in the state where the conveyance unit 2 is completely positioned, and FIG. 9B is a side view of the lock sensing portion 7 of the locking portion 6 in the state where the conveyance unit 2 is half-opened.

As shown in FIGS. 9A and 9B, the lock sensing portion 7 of the locking portion 6 includes a sensor arm 108 and a photosensor 121 in the vicinity of the lever 101. The sensor arm 108 and the photosensor 121 are provided to the apparatus main body 1

A distal end portion 108*a* of the sensor arm 108 in the vicinity of the lever 101 is applied with a force toward the lever 101 by a torsion spring 108*d*. Therefore, the sensor arm 108 is rotated around a rotating shaft 108*b* by the rotating motion of the lever 101. A flag portion 108*c* is formed at an upper end of the sensor arm 108. According to a position of the flag portion 108*c*, sensing light of the photosensor 121 is blocked or passed. As a result, a position of the lever 101 can be sensed.

According to such a construction, the lock sensing portion 7 can sense whether or not the locking portion 6 is locked as follows.

Firstly, as shown in FIG. 9A, in the locked state where the lever 101 is not erected, the sensing light of the photosensor 121 is blocked by the flag portion 108*c* of the sensor arm 108. When receiving a sensing signal from the photosensor 121, a controller 777 determines that the lever 101 is in the locked state.

Next, when the user releases the locking of the lever 101, the lever 101 is in the erected state as shown in FIG. 9B. Due to the operation of the lever 101, the sensor arm 108 is moved, so that the flag portion 108*c* doses not block the sensing light of the photosensor 121. When receiving a sensing signal from the photosensor 121, the controller 777 determines that the lever 101 is in the unlocked state.

Although not shown, when the conveyance unit 2 is drawn out from the apparatus main body 1 and a jam clearance operation is performed, the lever 101 is in the fallen state. Therefore, the lever 101 does not protrude from the outer surface of the conveyance unit 2.

The conveyance unit 2 can be separated from the apparatus main body 1 by separating the distal end portion 103*b* of the hook 103 from the pin 111. In this state, the spring 117 applies a force so as for the arm 120 integrally fastened to the hook 103 to rotate counterclockwise. As shown in FIG. 9A, the upper portion of the arm 120 presses the pressing portion 101*b*, so that the rotating lever 101 is not erected. As a result, the lever 101 does not protrude from the outer surface of the conveyance unit 2.

When the conveyance unit 2 becomes close to the locked state to the apparatus main body 1, the distal end portion 103*b* of the hook 103 contacts with the pin 111. In this state, if the user erects the lever 101, the pressing portion 101*b* enables the arm 120 to rotate clockwise, and the hook 103 integrally fastened to the arm 120 is also rotated.

Due to the clockwise rotation of the hook 103, the inserting operation of the conveyance unit 2 automatically starts. Namely, the conveyance unit 2 is inserted into the apparatus main body 1. Therefore, the distal end portion 103*b* of the hook 103 contacts with the pin 111. In addition, when the conveyance unit 2 is pushed into the apparatus main body 1, the taper portion H in the distal end portion 103*b* of the hook 103 is pressed from the pin 111, so that the hook 103 automatically rotates clockwise.

The lever 101 which is applied with a fore clockwise by the torsion spring is rotated clockwise due to the clockwise rotation of the arm 120. Therefore, the distal end portion of the lever 101 protrudes from the outer surface of the conveyance unit 2.

When the U-shaped recess 103*a* of the hook 103 is engaged with the pin 111 by further inserting the conveyance unit 2 into the apparatus main body 1, the hook 103 is rotated counterclockwise. Accordingly, the arm 120 is also rotated counterclockwise to press the pressing portion 101*b*. As a result, the lever 101 does not protrude from the outer surface of the conveyance unit 2.

Now, electrical conduction states associated with the drawing out and inserting of the conveyance unit 2 are described. Due to the aforementioned construction of the locking portion 6 and the lock sensing portion 7, the pressing portion 101*b* and the sensor arm 108 are rotated according to the rotation of the lever 101. In the embodiment, a timing that the sensor arm 108 releases the blocked state of the photosensor 121 is arranged to be precedent to a timing that the pressing portion 101*b* presses the arm 120. Therefore, before the hook 103 is disengaged from the pin 111, the controller 777 recognizes that the locking is released and disconnects electric power for the connectors 14 and 115. Accordingly, in the power-connected state, the relay drawer connectors 105 are 106 cannot be disconnected from the connectors 114 and 115, and the conveyance unit 2 cannot be drawn out from the apparatus main body 1.

(Procedures of Controlling and Displaying in Jam Removing Operation)

Figure 10:
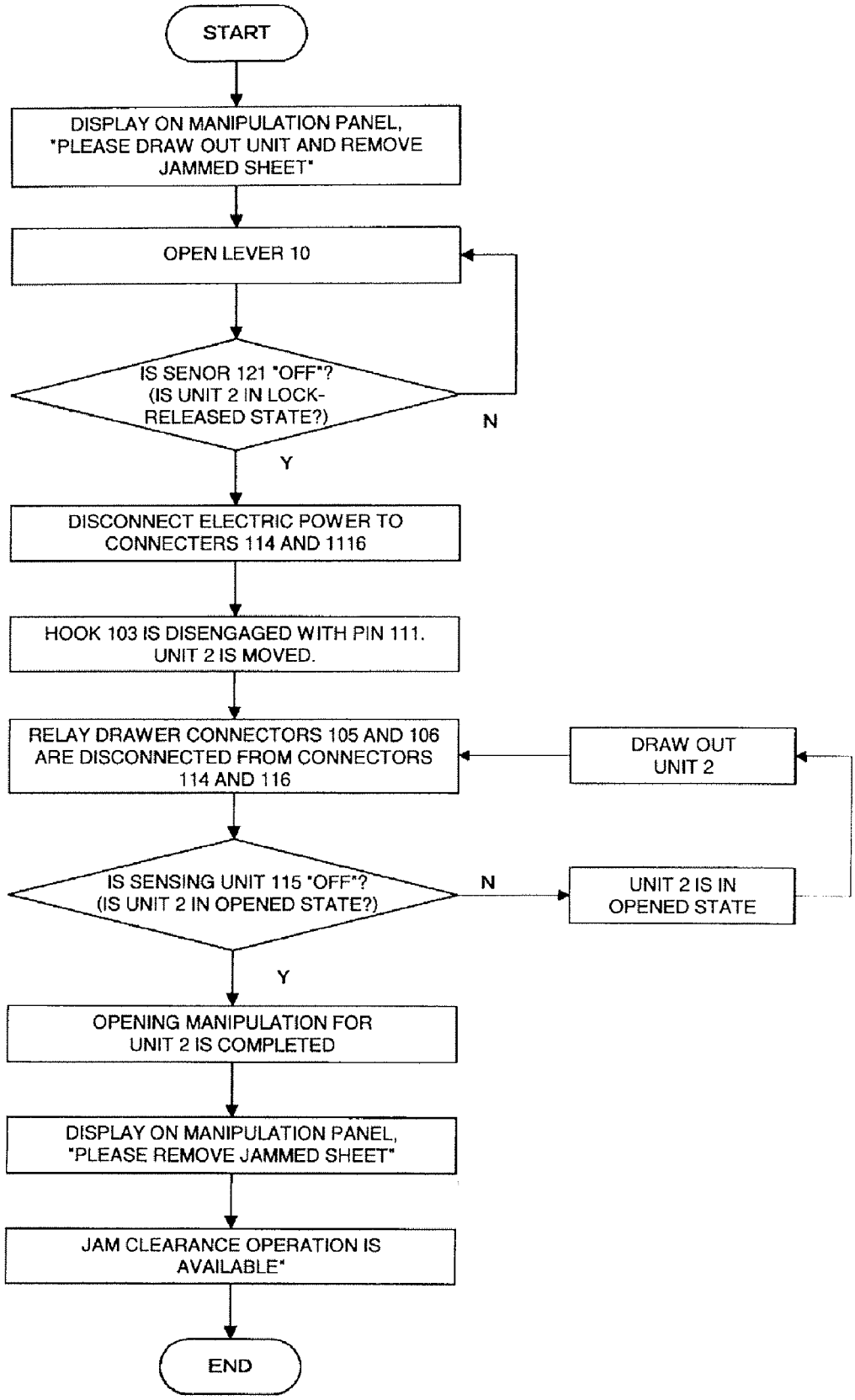
FIG. 10 is a flowchart of operations performed at the time of occurrence of paper jam.
Figure 11:
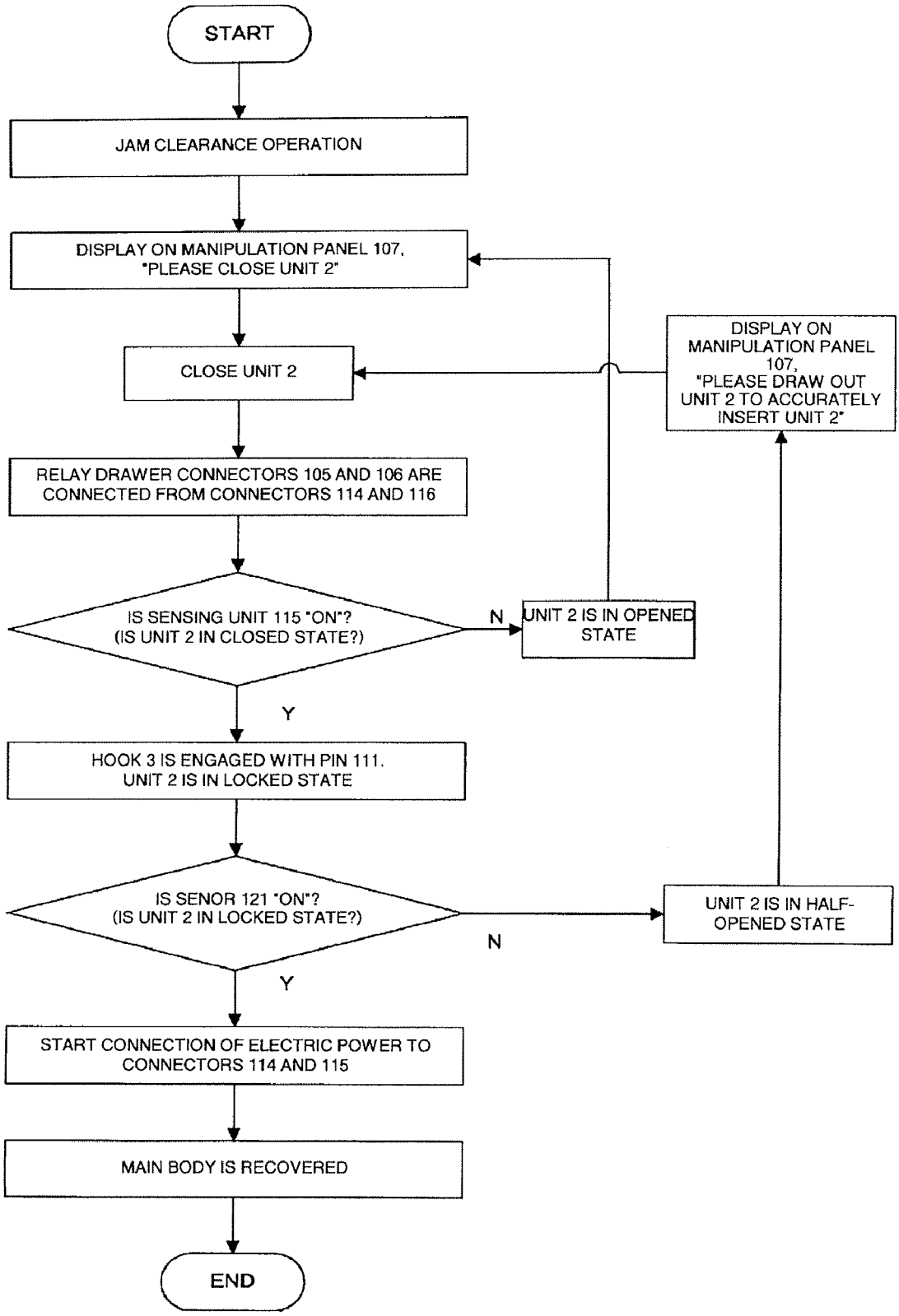
FIG. 11 is a flowchart of operations performed after the ending time of an operation of removing a jammed transfer material S.

Now, procedures of controlling and displaying performed in a jam clearance operation are described with reference to flowcharts of FIGS. 10 and 11. FIG. 10 is a flowchart of operations performed from the time of occurrence of paper jam. In other words, operations of drawing out the conveyance unit 2 are illustrated. FIG. 11 is a flowchart of operations performed after the ending time of an operation of removing a jammed transfer material S.

Firstly, as shown in FIG. 10, at the time of occurrence of paper jam, the controller 777 controls a liquid crystal display (display unit) 107 disposed to the apparatus main body 1 to display information indicating that the conveyance unit 2 needs to be drawn out and the jammed transfer material S (jammed paper) needs to be removed. When the user manipulates the lever 101, the controller 777 receives a lock "OFF" signal (locking-released signal) sensed by the lock sensing portion 7. After that, the controller 777 disconnects the electric power for the relay drawer connectors 105 and 106 before the hook 103 is disengaged from the pin 111.

In the unlocked state where the hook 103 is disengaged from the pin 111, the conveyance unit 2 is moved to be separated from the apparatus main body 1 by the slide mechanism 130. As a result, the relay drawer connectors 105 and 106 are disconnected from the connectors 114 and 116, respectively. According to the procedures, the connection and disconnection of the connectors 114 and 116 in the power-connected state can be prevented.

When the controller 777 determines based on the sensing signal of the sensing portion 115 that the conveyance unit 2 is in the OFF state (the state where the conveyance unit 2 is separated from the apparatus main body 1), the controller 777 determines that the opening of the conveyance unit 2 is completed. The controller 777 controls the liquid crystal manipulation panel 107 to display information that the jammed transfer material S needs to be removed. Accordingly, since an accurate state can be displayed, the user can perform a suitable manipulation at a proper timing.

As described above, when the conveyance unit 2 is inserted into the apparatus main body 1, the controller 777 performs the sensing of the sensing portion 115 for sensing the position of the conveyance unit 2 and, after that, the sensing of the lock sensing portion 7. On the other and, when the conveyance unit 2 is drawn out from the apparatus main body 1, the controller 777 performs the sensing of the lock sensing portion 7 and, after that, the sensing of the sensing portion 115 for sensing the conveyance unit 2. Accordingly, connection and disconnection of the connectors in the power-connected state can be prevented.

As shown in FIG. 11, when the operations of removing the jammed transfer material S from the apparatus main body is completed, the controller 777 determines based on the sensing signal of the sensing portion 115 that the conveyance unit 2 is drawn out. The controller 777 controls the liquid crystal manipulation panel 107 to display information indicating that the conveyance unit 2 needs to be inserted. When the user inserts the conveyance unit 2 into the apparatus main body 1, the controller 777 determines based on the sensing signal of the sensing portion 115 that the conveyance unit 2 is inserted into main body 1. After determining based on the sensing signal of the sensing portion 115 that the conveyance unit 2 is in a position close to the apparatus main body 1, the controller 777 determines based on a signal of the lock sensing portion 7 of the locking portion 6 whether or not the hook 103 is engaged with the pin 111. Namely, the controller 777 performs sensing of the state of locking.

In the lock-failure state where the hook 103 is not completely engaged with the pin 111, the controller 777 controls the liquid crystal manipulation panel 107 to display information indicating that the conveyance unit 2 needs to be drawn out and completely inserted again. Accordingly, since the user can be informed accurately, the workability to manipulation of drawing out and inserting the conveyance unit 2 to the apparatus main body 1 can be improved.

In the embodiment, if the half-opened state is sensed based on the sensing results of the lock sensing portion 7 and the sensing portion 115, the information indicating that the conveyance unit 2 needs to be drawn out and completely inserted again may be displayed. However, the display information is only an example. Therefore, any information indicating that the conveyance unit 2 is in the incompletely inserted state in the apparatus main body 1 may be displayed to the user.

When the user completely inserts the conveyance unit 2 into the apparatus main body 1, the controller 777 determines based on the sensing signal of the lock sensing portion 7 of the locking portion 6 that the conveyance unit 2 is inserted into the apparatus main body in the locked state. The controller 777 controls the electric power to be supplied through the connectors 114 and 116 to a heater of a fixing device 502 or a transfer material-conveying driving motor provided to the conveyance unit 2 or sensors. When the controller 777 determines that the conveyance unit 2 is in the locked state, the controller 777 controls the liquid crystal manipulation panel 107 to display information indicating that the image forming operation can be operated by the user.

According to the embodiment, the lock sensing portion 7 for sensing the locked state of the locking portion 6 is provided In addition, the user can determine the locked state by simply confirming the presence of the protrusion of the lever 101 from the conveyance unit 2. In addition, since the sensing portion 115 for sensing the position of the conveyance unit 2 is separately disposed, the half-opened state can be effectively determined. Since the sensed information is displayed on the liquid crystal manipulation panel 107, the user can recognize the locked state or the half-opened state by confirming the information displayed on the liquid crystal manipulation panel 107.

In the aforementioned embodiment, the pin 111 as an engagement protrusion for the locking portion 6 is disposed to the apparatus main body 1, and the lever 101 and the hook 103 having the U-shaped recess 103*a* as an engagement recess are disposed to the conveyance unit 2. However, the opposite construction may be adopted. In the opposite construction, in the half-opened state where the conveyance unit 2 is not completely locked to the apparatus main body 1, the lever 101 disposed to the apparatus main body 1 is arranged so as to protrude from an outer surface of the apparatus main body 1. Accordingly, like the aforementioned embodiment, the states of locking including the unlocked state can be recognized based on the position of the lever 101.

In addition, in the aforementioned embodiment, the sensing portion 115 for sensing the position of the conveyance unit 2 is disposed to the apparatus main body 1, and the flag 104 sensed by the sensing portion 115 is disposed to the conveyance unit 2. However, the opposite construction may be adopted.

This application claims the benefit of priority from the prior Japanese Patent Application No. 2006-083767 filed on Mar. 24, 2006 the entire contents of which are incorporated by reference herein.

What is claimed is:

1. An image forming apparatus which forms an image on a sheet, comprising:

an apparatus main body;

a unit which can be inserted into the apparatus main body;

a locking device which locks the unit to the apparatus main body when the unit is in a predetermined inserted state in the apparatus main body; and a protrusion member which protrudes from an outer surface of the unit or from an outer surface of the apparatus main body in a state in which the unit is inserted into the apparatus main body but not locked to the apparatus main body by the locking device.

2. The image forming apparatus according to claim 1, wherein, when the unit is drawn out from the apparatus main body, the protrusion portion does not protrude from an outer surface of the unit or an outer surface of the apparatus main body.

3. The image forming apparatus according to claim 1, wherein the protrusion member is a member manipulated to release the locking of the locking device, and the locking of the locking device is released by moving the protrusion member in a direction where the protrusion member protrudes from an outer surface of the unit or an outer surface of the apparatus main body.

4. The image forming apparatus according to claim 1, further comprising:

a unit position sensing portion which senses whether or not the unit is inserted in to the main body;

a lock sensing portion which senses whether or not the locking device locks the unit;

a display unit which displays the inserting manipulation of the unit to a user; and a controller which controls the display of the display unit based on results of sensing of the unit position sensing portion and the lock sensing portion, wherein the controller controls the display unit to display different inserting manipulations according to different cases including a case where the unit position sensing portion senses that the unit is not inserted into the apparatus main body, a case where the unit position sensing portion senses that the unit is inserted to the apparatus main body and the lock sensing portion senses that the locking device does not lock the unit, and a case where the lock sensing portion senses that the locking device locks the unit.

5. The image forming apparatus according to claim 4, wherein the controller controls the display unit to display to the user information indicating that the unit is incompletely locked to the apparatus main body in a case where the unit position sensing portion senses that the unit is inserted into the apparatus main body and the lock sensing portion senses that the locking device does not lock the unit.

6. The image forming apparatus according to claim 1, wherein the locking device comprises:

an engagement protrusion member which is disposed to one of the apparatus main body and the unit; and a hook which is disposed to the other one of the apparatus main body and the unit and has an engagement recess to be engaged with the engagement protrusion member, the unit is locked to the apparatus main body by engaging the engagement protrusion member with the engagement recess, and when the unit is moved in the inserting direction, the hook is moved by being contact with the engagement protrusion member, and due to the movement of the hook, the protrusion member protrudes from the outer surface of the unit or the outer surface of the apparatus main body, and when the hook is in a position where the engagement recess of the hook is engaged with the engagement protrusion member and the unit is locked to the apparatus main body, the protrusion member does not protrude from the outer surface of the unit or the outer surface of the apparatus main body.

7. The image forming apparatus according to claim 1, wherein the locking device includes a lock sensing portion which senses whether or not the unit is locked to the apparatus main body, and when the lock sensing portion senses that the locking of the unit to the apparatus main body is released, electric power from the apparatus main body to electric component in the unit is disconnected, and after the lock sensing portion senses that the unit is locked to the apparatus main body, the electric power connection to the unit starts.

* * * * *